United States Patent [19]

Diermayer

[11] 4,245,778

[45] Jan. 20, 1981

[54] VENT CONTROL ARRANGEMENT FOR COMBUSTION APPARATUS

[76] Inventor: Werner Diermayer, 1275 Panorama Dr., Lafayette, Calif. 94549

[21] Appl. No.: 2,897

[22] Filed: Jan. 12, 1979

[51] Int. Cl.[3] ..... F23L 3/00; G05D 23/08

[52] U.S. Cl. ..... 236/1 G; 236/93 R; 236/101 B; 126/285 R

[58] Field of Search ..... 126/285 R, 285.5, 285 A, 126/285 B; 236/93 R, 1 G, 101 B; 431/20

[56] References Cited

U.S. PATENT DOCUMENTS

| | | | |
|---|---|---|---|
| 3,073,296 | 1/1963 | Hollingsworth et al. | 236/93 R |
| 3,134,377 | 5/1964 | Kanoy | 236/93 R |
| 3,228,605 | 1/1966 | Diermeyer | 126/285 |
| 3,782,627 | 1/1974 | Akesson | 236/93 R |
| 3,847,066 | 11/1974 | Ham | 236/93 R |
| 4,141,495 | 2/1979 | Diermeyer | 236/93 R |
| 4,159,078 | 6/1979 | Diermeyer | 236/93 R |

FOREIGN PATENT DOCUMENTS

| | | | |
|---|---|---|---|
| 2017901 | 5/1970 | France | 236/93 |

*Primary Examiner*—James C. Yeung

*Attorney, Agent, or Firm*—Flehr, Hohbach, Test, Albritton & Herbert

[57] ABSTRACT

A vent control arrangement for energy conservation having bimetallic damper elements mounted in a draft hood which forms an integral part of the heating apparatus. The bimetallic elements open and close the flow passage for vent gases from the combustion apparatus in response to temperature change. The vent control arrangement is designed for minimum resistance to the flow of vent gases when installed in the integral draft hood. A design without friction surfaces and without transfer of movements or signals between components is used. Opening time is minimized by closeness to the heat source and in one embodiment by alternate bimetal reeds of different initial tension, in other embodiments by alternate orientation, or by different flexivity of alternate bimetal reeds.

3 Claims, 10 Drawing Figures

VENT CONTROL ARRANGEMENT FOR COMBUSTION APPARATUS

Vented, gas-fired appliances relying on natural draft for the removal of flue gases are equipped with a draft hood which isolates the combustion chamber from excessive updraft or backdraft in the vent. In many appliances, especially in residential warm air furnaces, the draft hood forms an integral part of the appliance. Vent dampers for energy conservation are usually installed downstream of the integral draft hood in the vent connector.

It is a general object of the invention to improve thermal vent dampers, specifically to minimize the resistance to the flow of vent gases through the vent dampers designed for installation in those draft hoods which form an integral part of the heating appliance.

The invention in summary combines minimal resistance to flow through vent dampers in integral draft hoods with the advantageous features of certain thermal vent dampers, such as: (a) location inside the draft hood for easy factory installation and protection during shipping; (b) design without bearings or friction surfaces to assure trobulefree function in the corrosive atmosphere of vent gases in spite of the small forces available from the bimetal actuating means; (c) the sensing means is the closing means, therefore any transfer of motions or signals between components is avoided and the function of the damper becomes extremely simple and reliable; (d) in addition to its primary job of saving energy during standby the damper provides modulating control of the vent passage during the operation of the appliance, prevent excessive loss of heated room air during cold, windy weather; (e) the damper opens quickly upon ignition of the appliance main burner since its location inside the draft hood is the closest possible position to the heat source compatible with its function as a vent damper; (f) a disproportionately large opening of the vent passage will be created during the initial opening phase by various arrangements shown in the embodiments.

Figure 1:
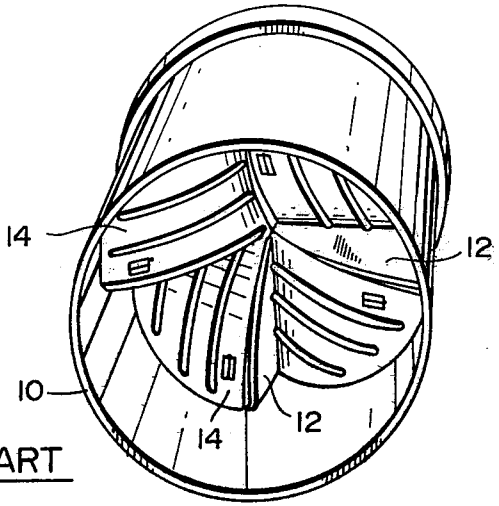
FIG. 1 PRIOR ART
FIG. 1 is a perspective view of a prior art thermally actuated vent damper.
Figure 3:
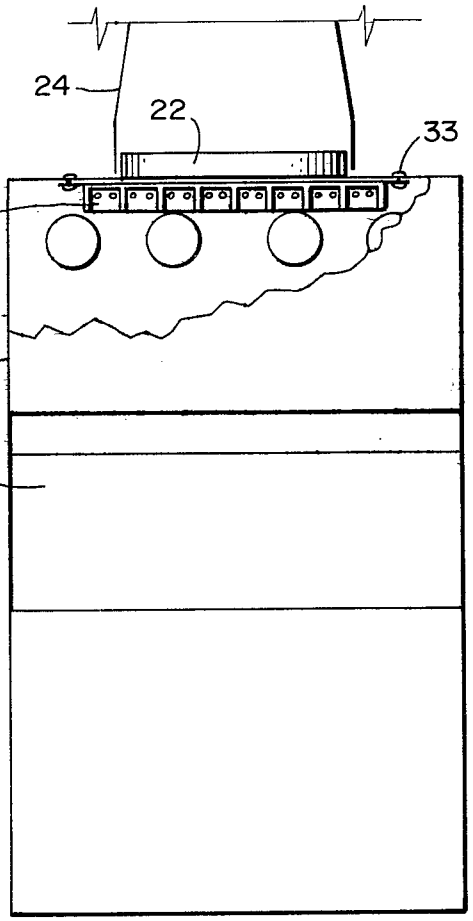
FIG. 3 is a front view of the same combustion apparatus with the front wall of the draft hood partially broken away to show the vent control arrangement.
Figure 2:
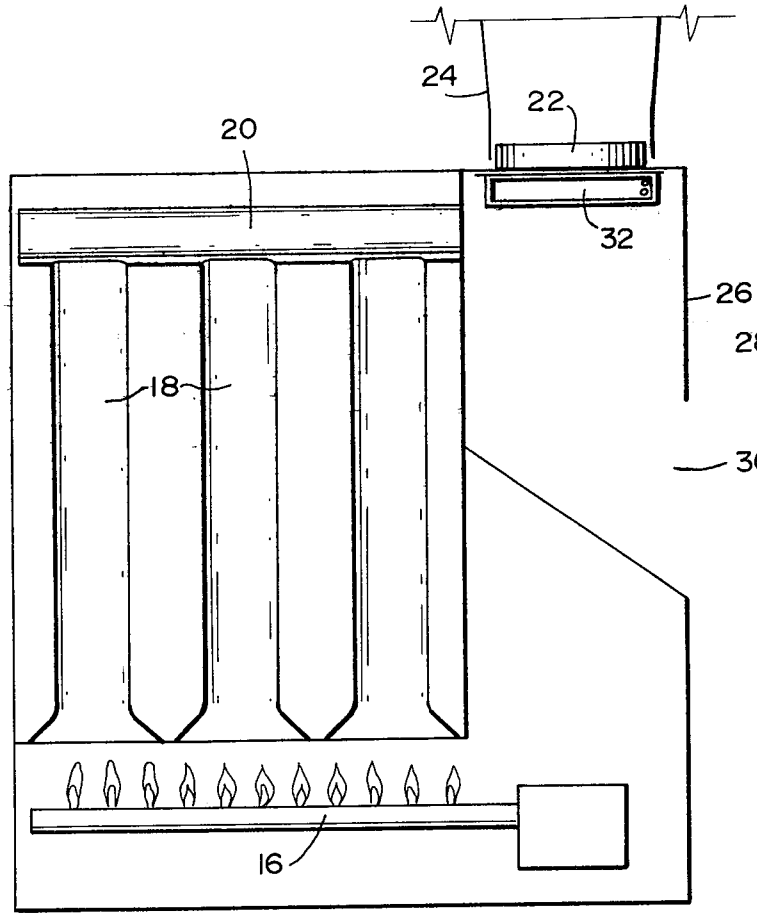
FIG. 2 is a vertical section view of a gas-fired combustion apparatus incorporating a vent control arrangement of the invention.

FIG. 1 shows a typical prior art thermally actuated vent damper. The damper comprises tubular housing 10 which is subdivided by partitions 12 into sections, illustrated as four quadrants. Each quadrant is covered by a thin slotted bimetal blade 14. The blades are attached at their upper edges to the partitions and curve upward into abutting relationship with the partitions when the damper is closed. the temperature of the hot flue gases causes the blades to change shape and uncurl to open the throttle area. The described vent damper is usually field-installed as a separate unit between the vent connector and the draft hood of a gas-fired heating appliance. FIGS. 2 and 3 show a known, typical heating appliance, such as a residential warm air furnace, comprising burner 16, heat exchanger 18, flue tubes 20, oval draft hood outlet 22, vent connector 24 which in this case is of the oval-to-round type for connection to a round vent pipe, walls 26 and 28 of the integral draft hood, and draft hood relief opening 30. The thermally actuated vent damper 32 of the invention is fastened to the top of the draft hood by fasteners 33. Components of the heating apparatus which are not related to the function of the vent damper have been omitted for clarity.

Figure 4:
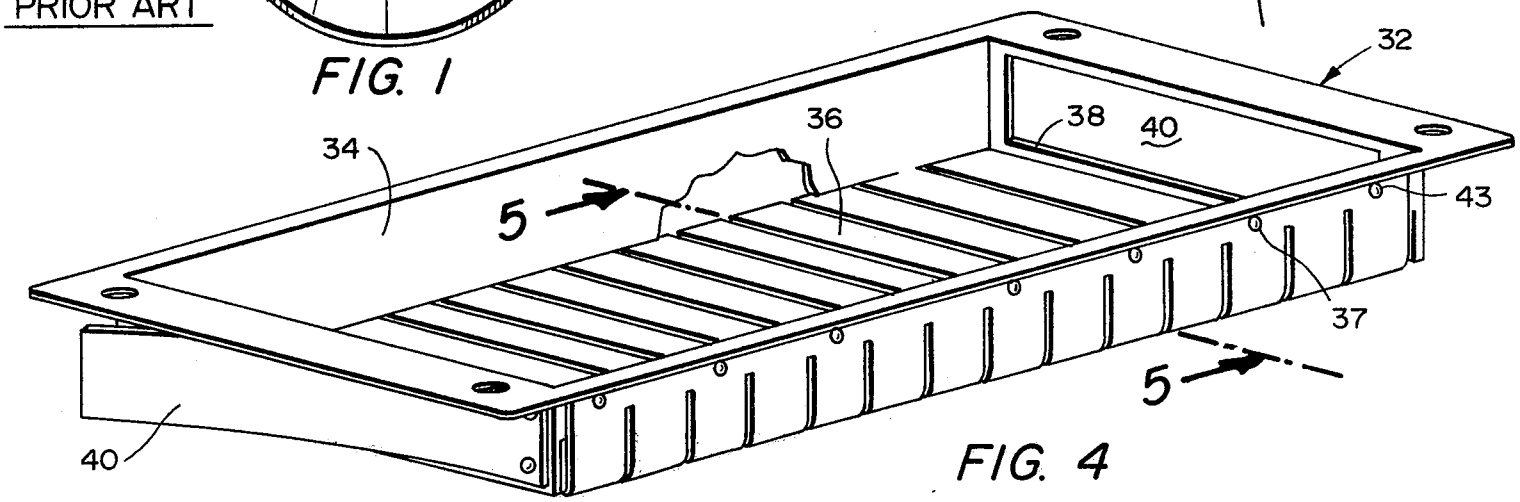
FIG. 4 is a perspective view to an enlarged scale of the vent damper employed in the embodiment of FIGS. 2 and 3.

Vent damper 32 is shown in greater detail in FIG. 4. The damper comprises a generally box-shaped frame 34 and a single slotted, temperature-responsive bimetal blade 36. A rectangular closure passage or aperture 35 is formed in the bottom of the frame with the aperture lying in a plane spaced from and at a position upstream of the outlet 22. The bimetal blade is L-shaped with the horizontal portion covering the aperture 35 and with the vertical portion extending upward and being provided with holes for securing to frame 34 by rivets 37, or by other fastening means such as bolts. Both lateral ends of frame 34 are provided with rectangular openings or apertures 38. The openings 38 are covered by strips of temperature-responsive bimetal 40, one of which is shown in partially open position.

Figure 5:
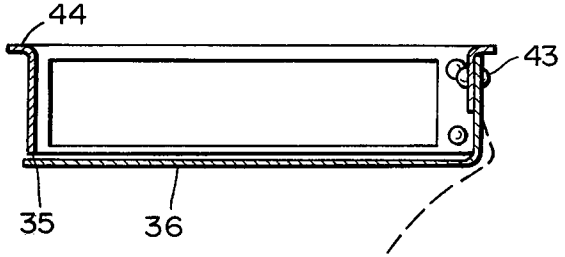
FIG. 5 is a vertical section through the vent damper taken along the line 5—5 of FIG. 4.

Instead of one slotted bimetal blade 36 the closing means may also consist of a number of juxtaposed strips of bimetal, as indicated in 32, FIG. 3. In either case the sectional view through the blade is as shown in FIG. 5. The closing means 36 is fastened by rivets 43 to frame 44. Dashed line 36' indicates the fully open position of the closing means 36.

When the appliance main burner is turned on the temperature-responsive bimetal blades 36 and 40 in FIG. 4 are heated by the flue gases. They flex toward their open position and allow the flue gases to flow along a discharge path through the vent damper into vent connector 24.

The length of the vent damper shown in FIG. 4 and the other embodiments is limited only by the longest horizontal inside dimension of the draft hood. This dimension is usually much larger than the longer diameter of the oval draft hood outlet. The vent damper is dimensioned to provide a closure passage for the flue gases having a cross-sectional area that is much larger than the cross-sectional area of the draft hood outlet. The velocity of the flue gases flowing through the vent damper is therefore much lower than it is at the draft hood outlet. Since the loss of pressure of a fluid due to resistance increases at the square of the velocity the present embodiment causes only a fraction of the pressure drop of prior art vent dampers. This is a decisive advantage in natural draft venting systems which rely on the weak buoyancy force of the flue gases for their removal from the premises. The present embodiment can therefore be installed in systems having marginal draft capability, caused by short vertical vents and/or high resistance components, such as lateral runs and several elbows.

In the present embodiment the advantage of minimal resistance to flow is combined with a number of other features that improve its function and widen its energy-conservation applications.

The vent damper is designed to be located inside the draft hood. In contrast to other vent dampers which form separate units outside the draft hood the present embodiment may be factory-installed which reduces cost compared to field installation or retrofitting. When factory-installed it is also well protected from damage during shipping.

Thermally actuated vent dampers relay for their opening and closing movements on the relatively small forces of temperature-responsive bimetal. It is therefore preferable to design thermal vent dampers without any bearings, hinges or other friction surfaces, as demonstrated in the present embodiment.

The reliability of vent dampers according to the present embodiment is further increased by combining the temperature-sensing, the actuating, and the opening/-closing functions in one and the same part. No transfer of movements or signals from one component to another is required.

Vent dampers according to the present embodiment provide modulating draft control by the continuous and nearly instantaneous response of the bimetal blades, or strips, to temperature differences in the flue gases. When a strong draft aspirates an excessive amount of dilution air through the draft hood relief opening the temperature of the mixture of flue gases and dilution air decreases and the bimetal blades, or strips, close partially, until a new equilibrium at a lower rate of dilution air is established. In addition to their primary job of saving energy by closing the vent during standby the embodiments of this invention reduce heat loss also during the operating phases of the appliance by the described modulating action.

The vent damper location as shown in FIGS. 2 and 3 is the closest possible position to the heat source consistent with its function as a vent damper. The close proximity of the vent damper to the hot flue gases flowing from the heat exchanger into the draft hood causes the bimetal blades, or strips, to open quickly upon ignition of the main burner and reduces possible spillage of flue gases at the draft hood relief opening during startup.

Figure 6:
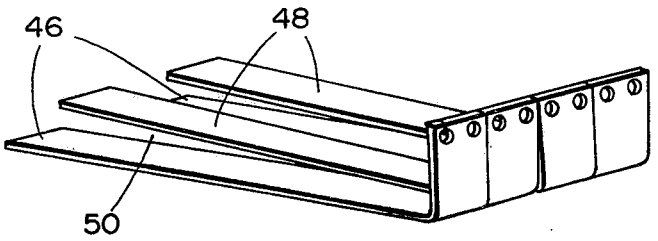
FIG. 6 show the bimetal actuating means of another embodiment during the initial opening movement.

FIG. 6 shows an arrangement that further reduces the opening time. Two types of bimetal strips are alternately mounted side-by-side in the vent damper. They are formed in such a manner that, when installed in the vent damper, the distal end of strip 46 exerts a slightly lower force against a stop, such as the vent damper frame, at room temperature than adjacent strip 48. Typical forces against the stop, at room temperature, are one-half ounce for strip 46 and one ounce for strip 48. When hot flue gases reach the vent damper the bimetal strips 46 open ahead of bimetal strips 48, thereby forming passages 50 between the bimetal strips in addition to those at the ends of the strips and at the sides of the vent damper. A disproportionally large total passage is thereby created during the first moments of the opening movement. The flow of flue gases around the entire bimetal strips increases the heat transfer from the flue gases to the bimetal strips and accelerates their further opening movement. The same effect can be achieved by using a single slotted bimetal blade of the type described for FIG. 4 and bending all even-numbered ends up sufficiently so that when installed in the vent damper frame they press against the frame at a slightly higher force. When heated by the flue gases the odd numbered ends of the slotted bimetal blade move from the stop sooner than the even numbered ends and create passages between each other, as described before.

Another method for increasing the passage through the vent damper during the initial phase of the opening movement is the alternate side-by-side installation of bimetal strips having higher and lower thermal deflection. The strips having higher theral deflection will curve faster and their position relative to the adjoining strips shortly after the start of the opening movement will again be as shown in FIG. 6. Thermal deflection occurs in bimetal upon temperature change approximately according to the formulas:

$$B=(0.53\ F\times\Delta T\times L^2)/t$$

where B is the deflection of the distal end of the strip, F is the flexivity (the property of the specific type of bimetal that determines the rate of deflection), $\Delta T$ is the difference between the two temperatures at which deflection B occurs, L is the free length and t the thickness of the bimetal strip.

When adjacent bimetal strips exert different forces against a stop, such as the frame, at room temperature and therefore start moving from the frame at different moments during the opening phase the gap between adjacent strips tends to remain the same while the opening movement continues. When adjacent bimetal strips are made of bimetal having different thermal deflection the gap appearing between them at the start of the opening phase tends to increase as the opening movement continues. The combination of different forces against the stop and of different thermal deflections in adjacent bimetal strips makes possible designs having a wide variety of opening characteristics, such as a disproportionately large gap during the initial phase of the opening movement and an increasing, constant, or diminishing gap while the opening movement continues. This flexibility in the choice of opening characteristics allows the designer to adapt a vent damper to a particular type or model of heating appliance and to maximize energy savings derived from vent dampers.

A further method for increasing the passage through the vent damper during the initial phase of the opening movement is to have the bimetal strips fastened alternately to the opposite side of the vent damper frame.

Figure 7:
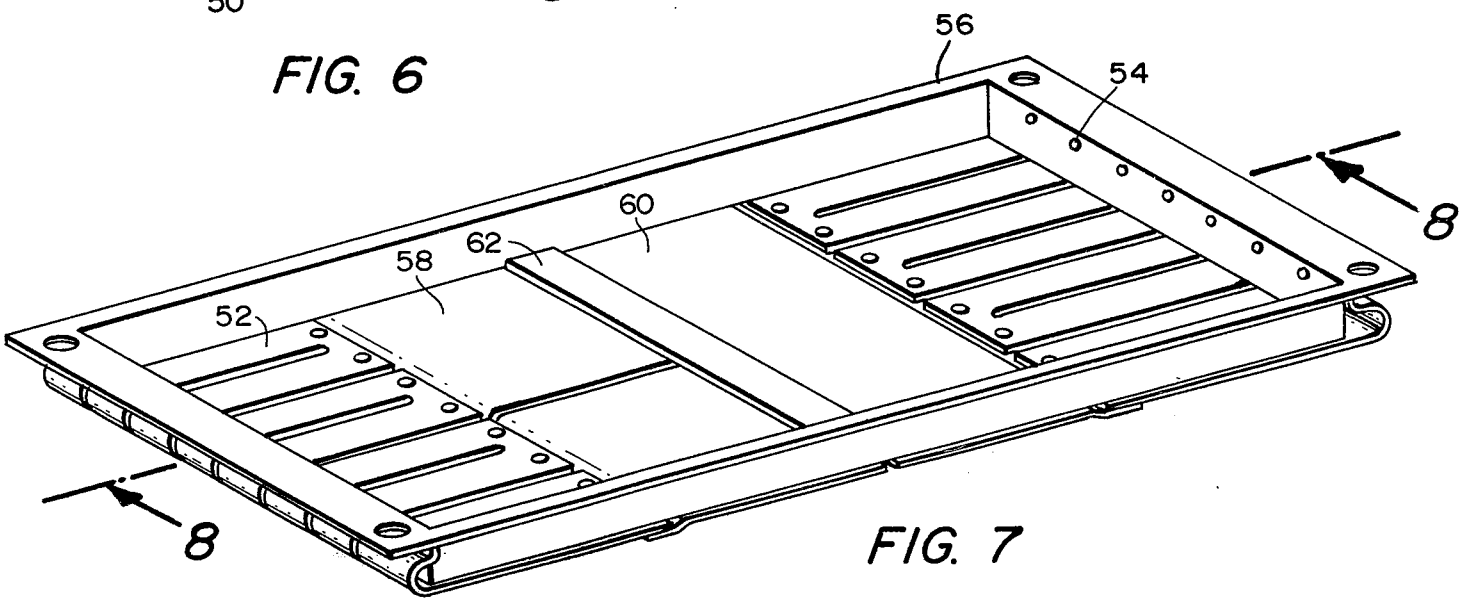
FIG. 7 is a perspective view of another embodiment of the invention.
Figure 8:
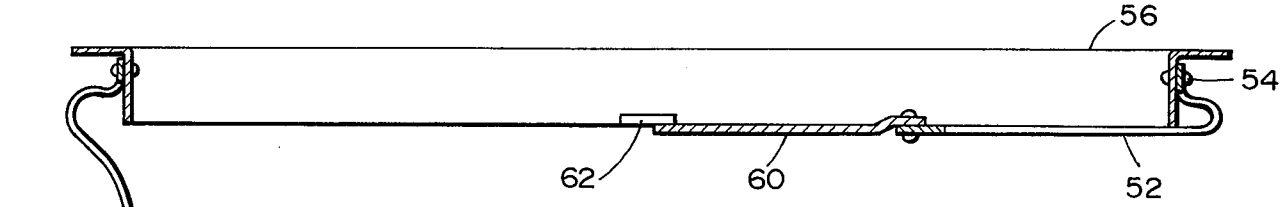
FIG. 8 is a vertical section view taken along the lines 8—8 of FIG. 7.

Another embodiment is shown in FIGS. 7 and 8. Slotted bimetal strips are fastened by rivets 54 at both ends of the vent damper frame 56. The bimetal strips 52, in their closed position, cover a portion of the passage for vent gases formed by frame 56. The remaining opening is covered by plates 58 and 60 of the type that does not change shape during temperature change. The plates 58 and 60 preferably are made of stainless steel sheet, or of any appropriate solid and relatively rigid material. The number of plates may vary from one for each half of the remaining opening, as shown at the right side of FIG. 7, to as many plates as there are individual bimetal strips. At the left side of FIG. 7 two plates are shown. FIG. 7 shows four bimetal strips for each half, each strip being slotted in the center to provide an effective length-to-width ratio for maximum deflection in the desired direction. A non-slotted, flat, nearly square or round blade of bimetal curves very little upon being heated and forms a slightly spheric surface. The number of bimetal strips may vary from many individual strips to one slotted blade for each half of the damper.

Bracket 62 serves as a stop for plates 58 in their closed position when several plates are used for each half of the vent damper opening. When only one plate is used, as shown at the right side of FIG. 7, bracket 62 is not needed and can be eliminated.

When the bimetal strips are heated by flue gases they curve and open the passage. Their fully open position is shown at the left side of FIG. 8.

Instead of closing means that reach from the edges to the center of the vent damper the closing means can be fastened at the center web and reach out to the edges. Closing means can also extend both from the edges and from the center so that the freely moving ends of the closing means meet at lines halfway between the center and the edges of the frame.

Figure 10:
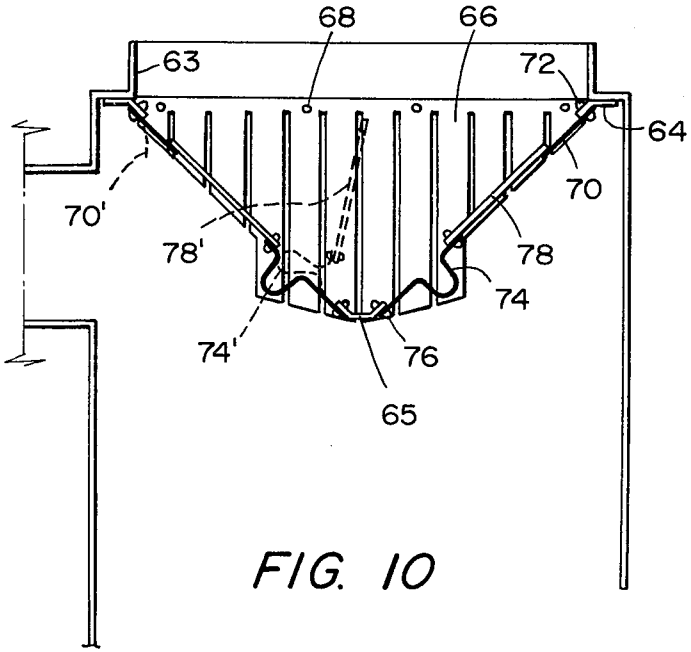
FIG. 10 is a vertical section taken along the line 10—10 of FIG. 9.
Figure 9:
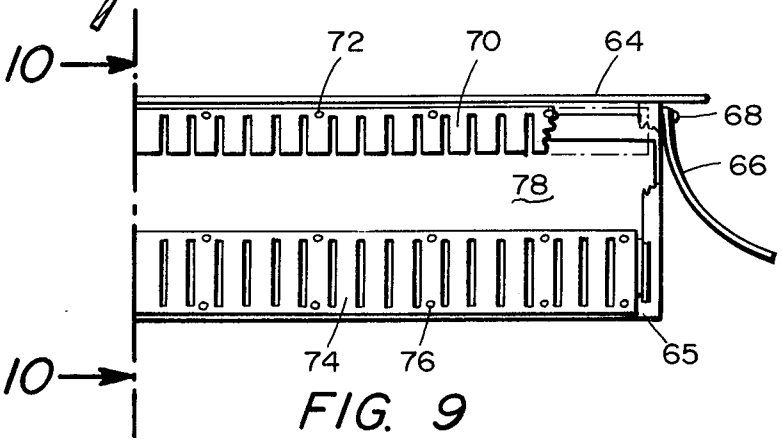
FIG. 9 is a side view of another embodiment of the invention.

FIGS. 9 and 10 show an additional embodiment. FIG. 10 is a vertical section of the vent damper installed in a typical draft hood having an outlet 63. FIG. 9 is a side view of the right half of the vent damper. The vent damper comprises a frame 64 which is generally triangular in end view. The top rim of the frame serves to fasten the vent damper flush to the ceiling of the draft hood. The frame includes opposite sides which converge downwardly within the hood and are joined at its apex by a trough 65 in the center over the entire length. The sides and ends of the frame are formed with rectangular closure passages or apertures. The combined cross-sectional area of the side and end apertures is substantially larger than the cross-sectional area of draft hood outlet 63. A slotted bimetal blade 66 is fastened by rivets 68 to each end of the frame. At room temperature these bimetal blades assume a flat shape and cover the apertures in the ends of the vent damper. Slotted bimetal blades 70 are fastened by rivets 72 along both sides of the upper portion of the frame. In FIG. 9 blade 70 is partially broken away to better show the frame. At room temperature the bimetal blades 70 cover the upper portion of apertures formed in the sides of the vent damper. Slotted bimetal blades 74 are fastened by rivets 76 to the trough 65. Sheet metal blades 78 are fastened to the distal ends of bimetal blades 74. At room temperature bimetal blades 74 and sheet metal blades 78 close the lower and central portion of the apertures formed in the sides of the vent damper.

When the appliance is turned on and hot flue gases reach the vent damper the bimetal blades 66 flex outward as shown in FIG. 9. Bimetal blades 70 flex outward from the apertures of the vent damper as indicated by dashed line 70' and bimetal blades 74 flex inward, assuming, together with sheet metal blades 78, the position 74' and 78' in FIG. 10.

The described movement of the various sets of bimetal blades creates openings for the passage of flue gases, whereby the sum of the openings is considerably larger than the cross-sectional area of the draft hood outlet.

What is claimed is:

1. A vent control arrangement for use with a gas-fired heating apparatus, including the combination of a draft hood for receiving gases from the apparatus, a relief opening, and an outlet for directing a discharge flow of gases to a vent, a damper frame mounted within the draft hood, means forming a closure passage in the damper frame at a position upstream of the draft hood outlet and with the passage having a cross-sectional area greater than the cross-sectional area of said outlet, and temperature-responsive means shaped to project across the closure passage and to change shape responsive to temperature change for opening and closing the passage, said temperature-responsive means including a plurality of bimetal strips disposed across the closure passage, with at least one of said strips being formed of a bimetal having a given flexivity and which is disposed in side-by-side relationship with one or more other of said strips which is formed of a bimetal having a flexivity which differs from said given flexivity whereby the rate of change of shape for a given temperature change differs for the strips of different flexivity to provide additional openings between the strips and thereby achieve a disproportionately large opening of the closure passage during an initial phase of temperature change.

2. A vent control arrangement for use with a gas-fired heating apparatus, including the combination of a draft hood for receiving gases from the apparatus, a relief opening, and an outlet for directing a discharge flow of gases to a vent, a damper frame mounted within the draft hood, means forming a closure passage in the damper frame at a position upstream of the draft hood outlet and with the passage having a cross-sectional area greater than the cross-sectional area of said outlet, and temperature-responsive means shaped to project across the closure passage and to change shape responsive to temperature change for opening and closing the passage, and temperature-responsive means including a plurality of bimetal strips disposed across the closure passage, and with at least one of said strips having its distal end when in closed position exerting a given force against a stop and which is disposed in side-by-side relationship with one or more other of said strips having distal ends which exert a different force against a stop so that during an initial phase of change in temperature the rate of opening of the strips which exert the given force differs from the rate of opening of the other strips to achieve a disproportionately large opening of the closure passage.

3. A thermally controlled closure device for use with combustion apparatus which includes a draft hood having an outlet for directing gases along a discharge path, the closure device comprising a damper frame having at least one closure passage, and bimetal element means including a plurality of bimetal strips disposed across the closure passage, with certain of said strips being formed of a bimetal having a given flexivity and which is disposed in side-by-side relationship with one or more other of said strips which is formed of a bimetal having a flexivity which differs from said given flexivity whereby the rate of change of shape for a given temperature change differs for the strips of different flexivity to provide additional openings between the strips and thereby achieve a disproportionately large opening of the closure passage during an initial phase of temperature change, at least one of said strips having its distal end when in closed position exerting a given force against a stop and which is disposed in side-by-side relationship with one or more other of said strips having distal ends which exert a different force against a stop so that during an initial phase of change in temperature the rate of opening of the strips which exert the given force differs from the rate of opening of the other strips to achieve a disproportionately large opening of the closure passage.

* * * * *